United States Patent [19]

Cobb, Jr. et al.

[11] Patent Number: 4,989,125

[45] Date of Patent: Jan. 29, 1991

[54] REFLECTOR USING FRESNEL-TYPE STRUCTURES HAVING A PLURALITY OF ACTIVE FACES

[75] Inventors: Sanford Cobb, Jr., Saint Mary's Point; Richard A. Miller, Saint Paul, both of Minn.

[73] Assignee: Minnesota Mining and Manufacturing Company, Saint Paul, Minn.

[21] Appl. No.: 192,212

[22] Filed: May 10, 1988

[51] Int. Cl.[5] ..... F21V 7/00

[52] U.S. Cl. ..... 362/346; 362/327; 362/297; 362/61; 350/613

[58] Field of Search ..... 362/296, 297, 341, 346, 362/347, 348, 349, 61, 80, 327, 332, 309, 307; 350/613

[56] References Cited

U.S. PATENT DOCUMENTS

| | | | |
|---|---|---|---|
| 1,554,315 | 9/1925 | White | 362/349 |
| 2,421,277 | 5/1947 | Luce | 362/327 |
| 3,710,095 | 1/1973 | Donohue et al. | 350/613 |
| 4,041,306 | 8/1977 | Compton et al. | 362/297 |
| 4,360,863 | 11/1982 | Barnes et al. | 362/348 |
| 4,655,546 | 4/1987 | Noiasaka et al. | 350/613 |
| 4,680,679 | 7/1987 | Dilouya | 362/346 |
| 4,704,661 | 11/1987 | Kosmatka | 362/346 |

FOREIGN PATENT DOCUMENTS

| | | | |
|---|---|---|---|
| 696573 | 1/1931 | France | 362/328 |
| 2525733 | 8/1983 | France | 362/346 |
| 0161769 | 12/1979 | Japan | 362/297 |

*Primary Examiner*—Stephen F. Husar
*Assistant Examiner*—D. M. Cox
*Attorney, Agent, or Firm*—Donald M. Sell; Walter N. Kirn; Stephen W. Buckingham

[57] ABSTRACT

A reflector has a plurality of Fresnel-type structures, wherein at least some of said Fresnel-type structures have a plurality of active faces, for reflecting light in a plurality of directions.

10 Claims, 1 Drawing Sheet

REFLECTOR USING FRESNEL-TYPE STRUCTURES HAVING A PLURALITY OF ACTIVE FACES

FIELD OF THE INVENTION

The present invention relates to lighting elements utilizing Fresnel-type reflectors.

BACKGROUND OF THE INVENTION

A common type of lighting fixture utilizes a light source with a reflecting element to produce a collimated or partially collimated beam of light. The reflective element may be spherical or parabolic in shape or may utilize Fresnel-type structures to simulate the operation of such reflectors. Typically the light source is mounted at the optical center of such a reflective element.

A problem common to such reflectors relates to the mounting of the light source. Because the light source is typically mounted in a fixture that extends through the reflective element, no reflections occur from directly behind the light source. As a result the light fixture does not produce uniform brightness over its entire surface. It will actually appear dimmer in the region closest to the light source. Furthermore surrounding the central dark region will be a bright band. The apparent brightness will then become progressively less toward the outer portions of the fixture. Thus such a light fixture will appear to have significant nonuniformities in brightness, with darker regions in the areas nearest to and farthest from the optical center of the light fixture.

Another problem with such lighting fixtures arises in their very common usage in automotive applications. Many countries have limitations on the amount or brightness of light emitted in particular directions by various lights on an automobile. For example "fill lights" between the headlights of a car must not emit more than a specified amount of light in a forward direction. This is to prevent obscuring the view of oncoming motorists. Some of the most reliable light sources, however, will exceed such safety standards if the efficiency of the reflector is too great. The efficiency of the reflector may be reduced by darkening portions thereof or by reducing the specular reflectivity of the mirror. Both of these solutions, however, tend to produce lighting fixtures that are less aesthetically pleasing.

SUMMARY OF THE INVENTION

In the present invention a reflector is provided with a plurality of Fresnel-type structures. At least some of those Fresnel-type structures have two active faces and a riser. The use of multiple active faces allows light to be directed in different directions in order to provide a uniform level of brightness across a lighting fixture. Some of the active faces may also be used to discord unneeded or unwanted light.

DETAILED DESCRIPTION

Figure 1:
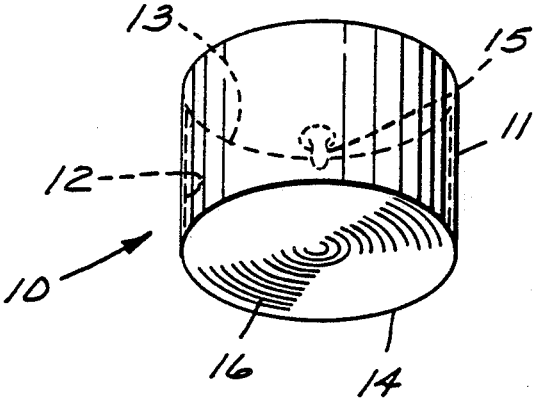
FIG. 1 is a view of a lighting fixture according to the invention.

FIG. 1 shows a lighting fixture 10 according to the invention. Lighting fixture 10 includes a housing 11 forming an optical cavity 12 having an optical window 13. Lighting fixture 10 further includes a reflective element 14 on a side of housing 11 opposed to optical window 13 and a light source 15. Reflective element 14 includes Fresnel-type structures 16 for collimating a portion of the light emitted by light source 15 and otherwise directing the remaining light to desired locations. Because light source 15 acts as a point source, Fresnel-type structures 16 are circular and concentric centered around light source 15. Alternatively, if a linear light source was used, the Fresnel-type structures should be linear and run parallel to the main axis of the light source.

Figure 2:
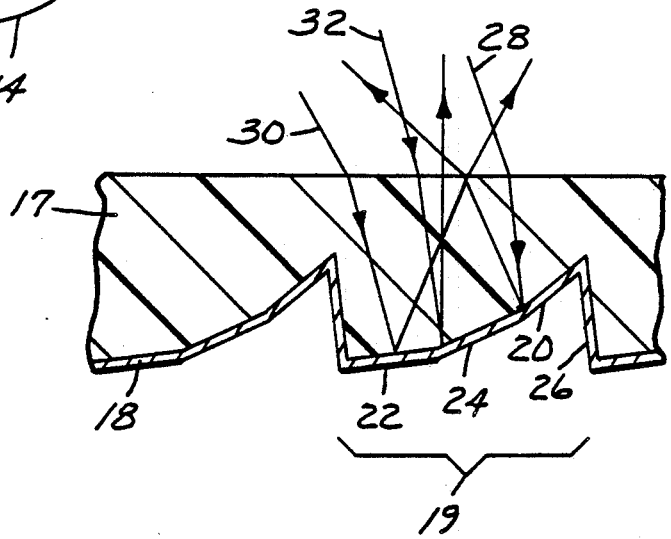
FIG. 2 is a schematic cross-sectional view of a first Fresnel-type structure used in a reflector according to the invention.

In a preferred embodiment Fresnel-type structures 16 are arranged in three concentric groups. FIG. 2 illustrates the structure of the Fresnel-type structures of the first group. Reflective element 14 comprises a transparent film 17, typically of a polymer material, and a reflective coating 18, typically of vacuum deposited metal. As may be seen in FIG. 2, the Fresnel-type structures are provided on the rear surface of the reflector. Nothing in the invention, however, precludes placing the Fresnel-type structures on the first surface.

In the preferred embodiment the members of the first group are provided in an inner band closest to light source 15. Fresnel-type structure 19 of FIG. 2 is typical of the Fresnel-type structures of this first group. Fresnel-type structure 19 includes a first active face 20, a second active face 22, a third active face 24, and a riser 26. First active surface 20 reflects light emitted by light source 15, such as light ray 28, toward the center of the optical window. Second active face 22 reflects light, such as light ray 30, to the side in order to discard such light with respect to a viewer observing the light fixture from the front. Active face 24 reflects light, as exemplified by light ray 32, in the manner of a conventional Fresnel-type reflector, i.e. mimicking the operation of a reflector having a preselected curvature. For example, active face 32 and other similar active faces may be designed to mimic the characteristics of a parabolic reflector.

Figure 3:
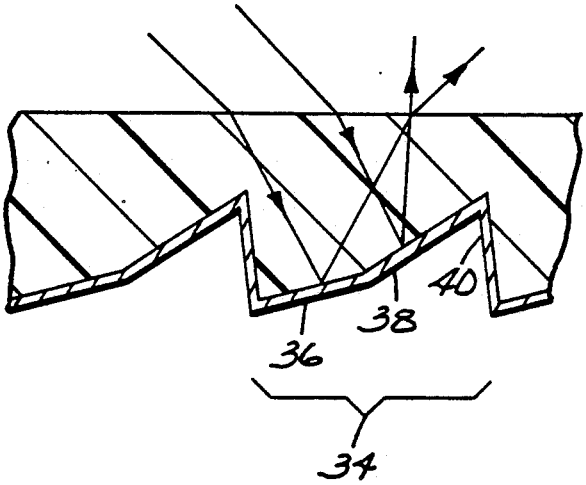
FIG. 3 is a schematic cross-sectional view of a second Fresnel-type structure used in a reflector according to the invention.

A second group of Fresnel-type structures is introduced concentric to and outside of the first group. FIG. 3 shows a cross-section of the Fresnel-type structures of the second group such as Fresnel-type structure 34. Fresnel-type structure 34 includes two active faces, 36 and 38, and a step 40. Active face 36 discards unneeded light in a manner similar to active face 22 of FIG. 2. Typically a smaller percentage of the light striking the second group of Fresnel-type structures will be discarded than is discarded by the first group of Fresnel-type structures. In this way the apparent brightness of the light fixture is made more nearly constant across its surface. Active face 38 acts to collimate light striking it in a manner similar to active face 24 of FIG. 2.

Figure 4:
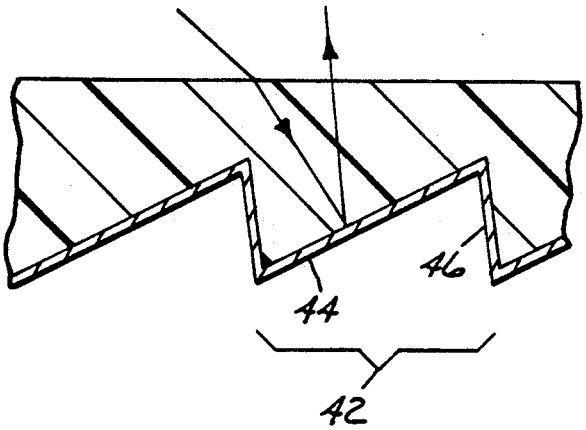
FIG. 4 is a schematic cross-sectional view of a third Fresnel-type structure used in a reflector according to the invention.

As the radius of the Fresnel-type structures increases, less of the light needs be discarded in order to maintain a uniform level of brightness across the light fixture. Eventually the radius becomes great enough that none of the light needs to be discarded. Thus a third group of Fresnel-type structures is introduced in the outer region of the reflector. FIG. 4 illustrates the Fresnel-type structures of the third group such as Fresnel-type structure 42. Fresnel-type structure 42 has an active face 44 and a riser 46. Active face 44 operates as a conventional Fresnel-type reflector and contributes to the collimated light output of the light fixture without discarding any of the light striking it.

What is claimed is:

1. A lighting fixture comprising:

a housing forming an optical cavity;

an optical window in said housing;

a light source in said optical cavity; and a reflector having a plurality of Fresnel-type structures on a side of said housing opposing said optical window, at least some of said Fresnel-type structures comprising two adjacent active faces and a riser, one of said active faces being positioned to collimate light from said light source and the other of said active faces being positioned to reflect light from said light source to a location on said optical window adjacent said light source.

2. The lighting fixture of claim 1 wherein said Fresnel-type structures are circular and concentric.

3. The lighting fixture of claim 2 wherein at least some of said Fresnel-type structures comprise two active faces and a riser, one of said active faces being positioned to collimate light from said light source and the other of said active faces being positioned to reflect light radially outward, away from said light source.

4. The lighting fixture of claim 2 wherein at least some of said Fresnel-type structures comprise three active faces and a riser, one of said active faces being positioned to collimate light from said light source, another of said active faces being positioned to reflect light from said light source to a position on said optical window adjacent said light source and the other of said active faces being positioned to reflect light radially outward, away from said light source.

5. A reflector having a plurality of Fresnel-type structures at least some of said Fresnel-type structures comprising first and second active faces and a riser, said first active faces being arranged to reflect light in a first predetermined direction and said second active faces being arranged to reflect light in a second predetermined direction, said second predetermined direction being different from said first predetermined direction, said first and second active faces being adjacent one another.

6. The reflector of claim 5 wherein at least some of said Fresnel-type structures comprise first, second and third active faces and a riser.

7. The reflector of claim 6 wherein said Fresnel-type structures are circular and concentric.

8. A reflector having a plurality of Fresnel-type structures, said Fresnel-type structures having bases defining a plane, at least some of said Fresnel-type structures comprising two adjacent active faces and a riser, each of said active faces making an acute angle with said plane.

9. The reflector of claim 8 wherein at least some of said Fresnel-type structures comprise three active faces and a riser, each of said active faces making an acute angle with said plane.

10. The reflector of claim 9 wherein said Fresnel-type structures are circular and concentric.

* * * * *